US009151575B2

(12) United States Patent
Pereira

(10) Patent No.: US 9,151,575 B2
(45) Date of Patent: Oct. 6, 2015

(54) FIREARM ACCESSORY RAIL AND METHOD OF ATTACHMENT

(71) Applicant: Robert Harold Pereira, Lavon, TX (US)

(72) Inventor: Robert Harold Pereira, Lavon, TX (US)

( * ) Notice: Subject to any disclaimer, the term of this patent is extended or adjusted under 35 U.S.C. 154(b) by 49 days.

(21) Appl. No.: 13/951,911

(22) Filed: Jul. 26, 2013

(65) Prior Publication Data

US 2015/0027024 A1 Jan. 29, 2015

(51) Int. Cl.
*F41G 11/00* (2006.01)
*F41C 23/12* (2006.01)

(52) U.S. Cl.
CPC ..... *F41G 11/003* (2013.01); *F41C 23/12* (2013.01); *F41G 11/004* (2013.01)

(58) Field of Classification Search
None
See application file for complete search history.

(56) References Cited

U.S. PATENT DOCUMENTS

| | | | | | |
|---|---|---|---|---|---|
| 3,925,902 | A * | 12/1975 | Gevers | 42/137 |
| 3,999,318 | A | 12/1976 | Tellie | |
| 4,536,966 | A * | 8/1985 | Engel | 42/137 |
| 4,890,407 | A * | 1/1990 | Nichols | 42/112 |
| 5,522,166 | A | 6/1996 | Martel | |
| 5,634,288 | A | 6/1997 | Martel | |
| 7,076,907 | B2 | 7/2006 | Nesseth et al. | |
| 8,407,925 | B2 * | 4/2013 | Fesas | 42/124 |
| 2012/0131838 | A1 * | 5/2012 | Edge et al. | 42/90 |
| 2013/0074685 | A1 | 3/2013 | Cottle | |
| 2013/0118051 | A1 | 5/2013 | Baker | |
| 2013/0219766 | A1 * | 8/2013 | Lee | 42/90 |
| 2014/0068994 | A1 * | 3/2014 | SCHULTZ et al. | 42/124 |

OTHER PUBLICATIONS

"Military Standard: Dimensioning of Accessory Mounting Rail for Small Arms Weapons," Department of Defense, Document No. MIL-STD-1913, Feb. 3, 1995, 11 pages.
"Picatinny rail," Wikipedia Foundation, Inc., dated Jul. 6, 2013, 3 pages. Retrieved Jul. 24, 2013 from http://en.wikipedia.org/wiki/Picatinny_rails.
"Rail Integration System," Wikipedia Foundation, Inc., dated Jun. 7, 2013, 1 page. Retrieved Jul. 24, 2013 from http://en.wikipedia.org/wiki/Rail_integration_System.
"Spring 2013 Catalog," Leapers, Inc., copyright 2013, pp. 30-63. Retrieved Jul. 24, 2013 from http://leapers.com/catalog.php.
"Weaver rail mount," Wikipedia Foundation, Inc., dated Jun. 7, 2013, 3 pages. Retrieved Jul. 24, 2013 from http://en.wikipedia.org/wiki/Weaver_rail.
PCT search report dated Aug. 18, 2014 regarding application PCT/US2014/031457, applicant Robert Pereira, 2 pages.
Magwedge SKS Kwik-Rail, posted Jun. 25, 2013, http://imgur.com/a/M4WSR/layoutIblog, retrieved on Nov. 18, 2014, 6 pages.
"I thought I'd share my Yugo project," posted Jul. 13, 2013, http://www.sksboards.com/smf/index.php?topic=121236.0, retrieved on Nov. 18, 2014, 8 pages.

* cited by examiner

*Primary Examiner* — Stephen M Johnson
(74) *Attorney, Agent, or Firm* — Yee & Associates, P.C.

(57) ABSTRACT

An accessory rail and method for attaching the accessory rail to a firearm is described. An accessory rail includes a first block and second block positioned respectively at a rear end and forward end of the accessory rail. The first block is configured to engage a first receiving area of the firearm, and the second block is configured to engage a second receiving area of the firearm. The accessory rail can advantageously be connected to a firearm such as the Samozaryadnj Karabin sistemy Simonova (SKS) assault rifle by utilizing manufactured points present in the SKS. The first block may engage a receiver cover attachment point. The second block may engage a receiving area present in the rear sight. No machining modifications to the firearm are required.

11 Claims, 8 Drawing Sheets

FIREARM ACCESSORY RAIL AND METHOD OF ATTACHMENT

BACKGROUND INFORMATION

1. Field

The present disclosure relates generally to firearms and, in particular, to an accessory rail for use with firearms. Still more particularly, the present disclosure relates to a firearm accessory rail and method of attaching the accessory rail to a firearm.

2. Background

In the field of armaments and firearms, various products and accessories are available for use with firearms. These accessories may include, for example, optical devices/scopes, illumination devices, range finders, laser devices, and various targeting aids. The variety of accessories available presents a user with different options from which to choose for various situations. A user may wish to use one kind of accessory with respect to one kind of objective or situation and may wish to use a different kind of accessory with a different objective or situation. For example, different kinds of scopes may be used in different conditions, light or dark, target shooting or field hunting. Thus, it is desired to provide a means by which a user may exchange accessories used with a firearm.

An accessory rail may be used with firearms in order to provide a means by which to attach various accessories to the firearm. For example, an accessory rail known as the Picatinny rail is described by Military Standard MIL-STD-1913. However, problems and issues are present with known accessory rails.

A popular firearm is the SKS assault rifle. The SKS is a firearm that originated in the Soviet Union; SKS is an acronym for Samozaryadnj Karabin sistemy Simonova, hereinafter SKS. The SKS has been manufactured in the millions both within the former Soviet Union and various licensee countries. The SKS is widely available in the United States as military surplus, and it is popular in the United States as a generally simple but robust assault rifle. Existing accessory rail systems do not function well with the SKS.

An accessory rail may suffer from a poor attachment to the firearm. Movement between the accessory rail and the firearm may cause an accessory, such as an optical device, to move out of alignment. Even a small movement of the accessory rail relative to firearm may cause the accuracy of the firearm to suffer. Firearms that are designed with high rates of discharge, such as a semiautomatic assault rifle, also suffer from movement of the accessory rail.

Thus, it would be advantageous to have a method and apparatus that takes into account at least some of the issues discussed above, as well as possibly other issues.

SUMMARY

In one illustrative embodiment, an apparatus may comprise a bar having a first end and a second end. The bar may be configured to engage a firearm. The bar may comprise an accessory rail. A first attachment structure may be positioned proximate the first end of the bar, and a second attachment structure may be positioned proximate the second end of the bar. The first attachment structure and the second attachment structure may be configured to attach the bar to the firearm. The frame structure may be configured to engage a rear sight of the firearm.

In another illustrative embodiment, an assembly may comprise a firearm and a rail. The firearm may include a rear sight. The rail may include a first connector structure and a second connector structure. The first connector structure may be positioned proximate a first end of the rail, and the second connector structure may be positioned proximate a second end of the rail. The first connector structure may be configured to attach the rail to the firearm at a first point. The second connector structure may comprise a block configured to enter a space in the rear sight of the firearm so as to attach the rail to the firearm at the second point.

In yet another illustrative embodiment, a method may be provided for attaching a rail apparatus to a firearm. A rail may include a block. The rail may be positioned on the firearm such that the block engages a receiving space in the firearm. The block may be attached to the firearm so as to secure the rail to the firearm.

The features, functions, and advantages may be achieved independently in various embodiments of the present disclosure or may be combined in yet other embodiments in which further details may be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and features thereof, will best be understood by reference to the following detailed description of an illustrative embodiment of the present disclosure when read in conjunction with the accompanying drawings, wherein:

DETAILED DESCRIPTION

Figure 1:
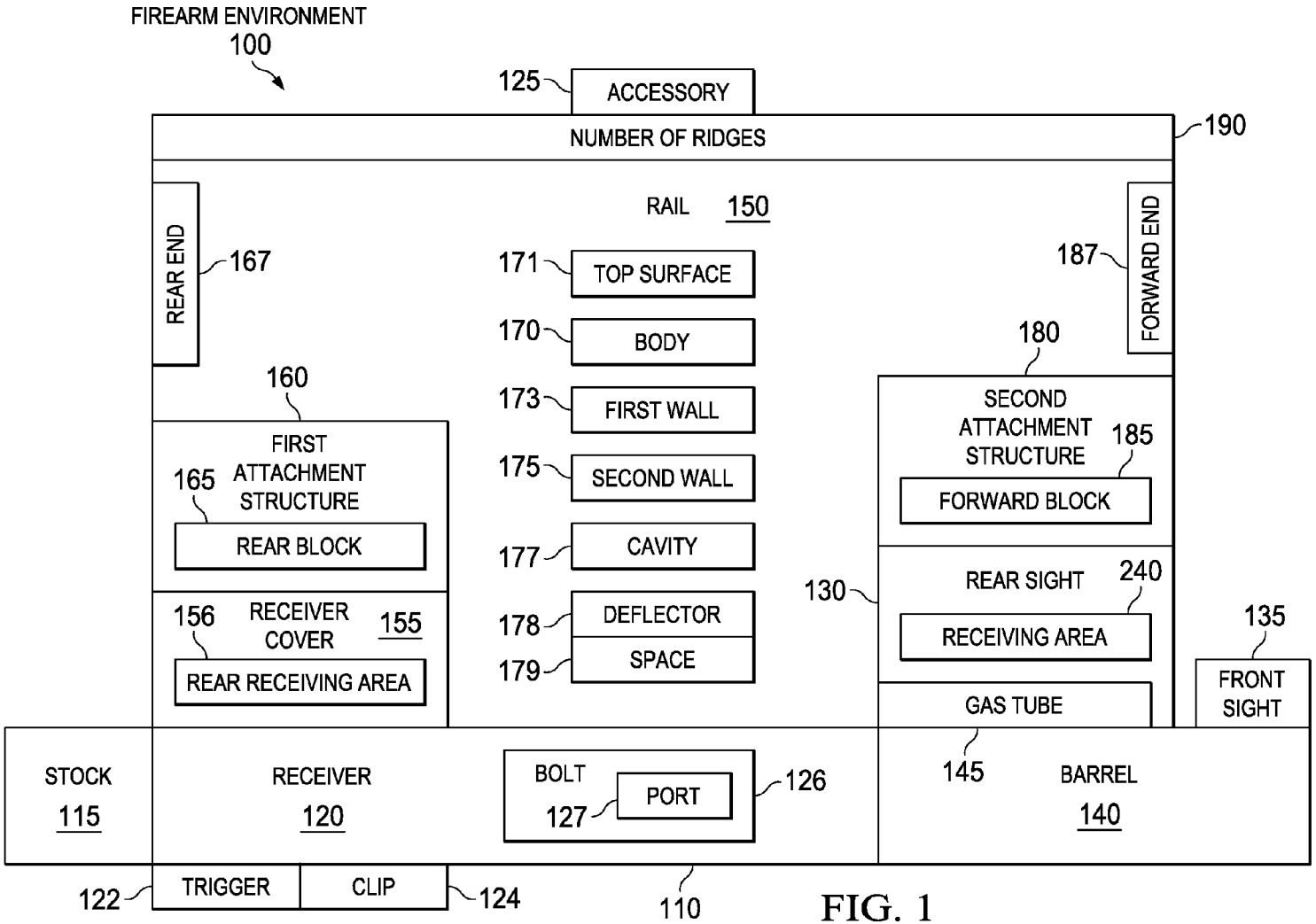
FIG. 1 is an illustration of a firearm environment in accordance with an illustrative embodiment.

The different illustrative embodiments recognize and take into account one or more different considerations. For example, without limitation, the different illustrative embodiments recognize and take into account that existing structures do not provide a stable platform upon which to affix accessories for the SKS firearm. For example, existing accessory rails that may be attached to the SKS firearm allow for excessive movement or wobble of the accessory rail. Such excessive movement limits the effectiveness of accessories such as optical scopes.

The different illustrative embodiments also recognize and take into account that the SKS firearm was not originally designed for or manufactured for use with an accessory rail. Accessory rails used with the SKS firearm are therefore add on items that must be accommodated to the existing firearm structure. Thus adapting an accessory rail for use with the SKS firearm presents difficulties in that an accessory rail must be adapted to the structure of the firearm.

The different illustrative embodiments also recognize and take into account that SKS assault rifles were typically produced with factory manufactured iron sights in the rear sight location and front sight location, rather than an accessory rail. The rear iron sight location may include a sight structure and an adjustable elevation sight positioned in the structure. As manufactured, the rear iron sight location of the SKS firearm presents a potential obstruction for the attachment of an accessory rail.

In addition the different illustrative embodiments recognize that an optical device attached directly to the rifle body may perform differently as compared to an optical device connected to an accessory rail which is itself mounted to the firearm. An accessory rail introduces other points of contact that may affect rifle performance.

Further, the different illustrative embodiments also recognize and take into account that the rear iron sight location of the SKS firearm includes a window structure that protects and provides access to a gas tube used in the gas recoil mechanism of the firearm. Modification or removal of the rear iron sight location may be disadvantageous in that it would expose the gas tube and/or render the window mechanism inoperable. Known accessory rails therefore do not modify the rear iron sight of the SKS firearm from its originally manufactured condition.

Thus, the different illustrative embodiments provide a method and apparatus connecting components to a firearm. For example, one illustrative embodiment provides an accessory rail and method of use with the SKS assault rifle. The accessory rail provides a robust and firm means of attachment to the rifle so as to provide a stable platform for other accessories. Further, the accessory rail may be attached to the SKS firearm while still allowing access to the gas tube through the window structure of the rear iron sight.

In one illustrative embodiment, an apparatus may comprise a body, a number of rails, a first attachment structure, and a second attachment structure. The first attachment structure and the second attachment structure may be positioned at substantially opposite ends of the body so as to provide two attachment points with sufficient distance between them so as to provide a secure attachment to the firearm. In addition, the second attachment structure may include an attachment block configured to enter and be received by the rear iron sight location of the firearm. The accessory rail described herein provides these and other advantageous features for use with the SKS firearm.

Unless otherwise noted and where appropriate, similarly named features and elements of illustrative embodiments of one figure of the disclosure correspond to and embody similarly named features and elements of embodiments of the other figures of the disclosure. With reference now to the figures and, in particular, with reference to FIG. 1, an illustration of a block diagram of a firearm environment is depicted in accordance with an illustrative embodiment. Firearm environment 100 may include firearm 110 and rail 150. Firearm 110 may comprise a SKS firearm. Rail 150 may be attached to firearm 110. Firearm 110 may include stock 115, receiver 120, trigger 122, clip 124, bolt 126, rear sight 130, front sight 135, barrel 140, and gas tube 145. Receive cover 155 may cover at least a portion of receiver 120. Accessory 125 may be attached to rail 150.

In these examples, the different components in firearm 110 may be associated with each other. A first component may be considered to be associated with a second component by being secured to the second component, bonded to the second component, fastened to the second component, and/or connected to the second component in some other suitable manner. The first component also may be connected to the second component through using a third component. The first component may also be considered to be associated with the second component by being formed as part of and/or as an extension of the second component.

Rail 150 may comprise first attachment structure 160, body 170, and second attachment structure 180. First attachment structure 160 may comprise rear block 165, and second attachment structure 180 may comprise forward block 185. Rail 150 may include number of ridges 190. Number of ridges 190 may comprise one or more number of ridges 190 that extend from top surface 171 of rail 150. Number of ridges 190 may comprise an alternating series of elevations and valleys configured to receive an accessory. Number of ridges 190 may substantially conform to a defined specification such as MIL-STD-1913 for what is known as a Picatinny rail. As used herein the phrase "number of" or "a number of" refers to one or more of the identified feature. Alternatively, number of ridges 190 may have a different configuration. In other words, other illustrative examples may be applied to other standards.

Body 170 may comprise top surface 171, first wall 173, and second wall 175. Top surface 171, first wall 173, and second wall 175 may define cavity 177. Cavity 177 may be configured so as to receive a portion of firearm 110. Body 170 may be positioned with respect to firearm 110 so as to have an engaged position and a disengaged position. At least one of top surface 171, first wall 173, and second wall 175 may be in contact with firearm 110 in the engaged position. In one illustrative embodiment, each of top surface 171, first wall 173, and second wall 175 contact firearm 110 in the engaged position. Contact between body 170 and firearm 110 may serve to substantially engage rail 150 to firearm 110 so as to provide a secure and steady platform upon which to affix accessory 125 related to performance of firearm 110.

Rail 150 may include forward end 187 and rear end 167. Forward block 185 may be attached to rail 150 proximate forward end 187, and rear block 165 may be attached to rail 150 proximate forward end 187. Forward block 185 and rear block 165 may also be attached to rail 150 at other positions. In one illustrative embodiment, forward block 185 and rear block 165 are attached at substantially opposite ends of rail 150, such as forward end 187 and rear end 167, in order to provide a desired separation between forward block 185 and rear block 165. The separation between forward block 185 and rear block 165 may aid in the stability of rail 150 as a platform for accessory 125. Rail 150 may be connected to firearm 110 in at least one of first attachment structure 160 and second attachment structure 180.

As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C, or item B and item C. In other examples, "at least one of" may be, for example, without limitation, two of item A, one of item B, and 10 of item C; four of item B and seven of item C; and other suitable combinations.

Firearm 110 may include receiver 120. Receiver cover 155 may be positioned in the area of receiver 120. Receiver cover 155 may serve to cover and protect moveable items of firearm 110 such as bolt 126. Receiver cover 155 may be affixed to firearm 110 in rear receiving area 156. In use of rail 150, receiver cover 155 may be removed from firearm 110 and first attachment structure 165 may be affixed in rear receiving area 156.

Firearm 110 may also comprise bolt 126 which operates within receiver 120. Port 127 may be disposed with respect to receiver 120 so as to allow shells to be ejected from receiver 120. Bolt 126 may reciprocate in the withdrawal, ejection, and placement of shells. Rail 150 may include deflector 178 and space 179 which may direct movement of shells as they are ejected from firearm 110. Space 179 may define an area within rail 150 through which shells may be ejected. Deflector 178 may provide a structure such that shells contact deflector 178 and are moved in a desired direction. For example, shells may be moved in a lateral direction or forward direction relative to firearm 110.

Figure 2:
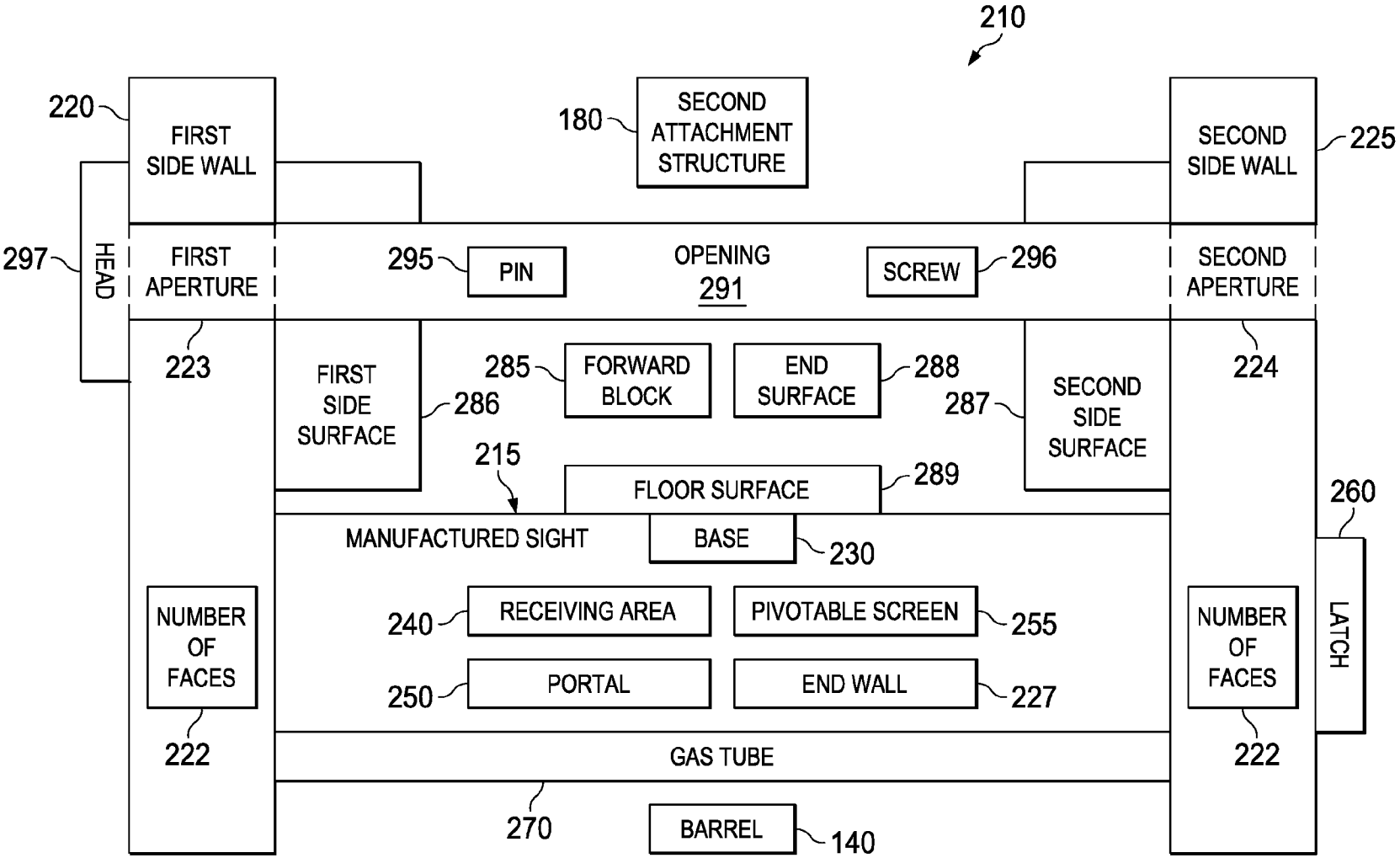
FIG. 2 is an illustration of a rear sight environment in accordance with an illustrative embodiment.

With reference now to FIG. 2, an illustration of a rear sight environment is depicted in accordance with an illustrative embodiment. Rear sight environment 210 may include rear sight 130 as depicted in FIG. 1. Rear sight environment 210 may include manufactured sight 215. Manufactured sight 215 may comprise a structure as originally manufactured for the SKS firearm. Manufactured sight 215 may rest upon or be affixed to barrel 140 during manufacture. Manufactured sight 215 may include first side wall 220, second side wall 225, end wall 227, and base 230. First side wall 220, second side wall 225, end wall 227, and base 230 may together define receiving area 240. First side wall 220 may include number of faces 222 and second side wall 225 may include number of faces 222. First side wall 220 may include first aperture 223, and second side wall 225 may include second aperture 224. First aperture 223 and second aperture 224 may be substantially aligned so as to receive a linear member therebetween.

Manufactured sight 215 may also include portal 250. Portal 250 may comprise a pivotable screen 255 and latch 260. Pivotable screen 255 may be pivotably mounted to first wall 220 and second wall 225. Pivotable screen 255 may move between an open position and a closed position. Latch 260 may be attached to second wall 225, and latch 260 may be manipulated so as to move from a first latch position to a second latch position. Movement of latch 260 from the first latch position to the second latch position may also move pivotable screen 255 from the closed position to the open position and vice versa. In the closed position, pivotable screen 255 may secure gas tube 270. In the open position, pivotable screen 255 may open so as to allow a user to access gas tube 270 for cleaning, for example. Latch 260, in moving from first latch position to second latch position, may sweep across second aperture 224 in second side wall 225.

Second attachment structure 180 may include forward block 285. Forward block 285 may be positioned within receiving area 240. Forward block 285 in FIG. 2 is an example of one implementation for forward block 185 in FIG. 1. Forward block 285 may be positioned such that a portion of forward block 285 is disposed within receiving area 240. Forward block 285 may include first side surface 286, second side surface 287, end surface 288, and floor surface 289. Forward block 285 may also include opening 291 that runs through forward block 285 from first side surface 286 to second side surface 287.

Forward block 285 may be configured so that one or more surfaces of forward block 285 contact one or more portions of manufactured sight 215 when rail 150 of FIG. 1 is engaged with firearm 110. Thus, for example, first side surface 286 may contact first side wall 220; second side surface 287 may contact second side wall 225; end surface 288 may contact end wall 227; and floor surface 289 may contact base 230. In addition, forward block 285 may be positioned within receiving area 240 such that opening 291 in forward block 285 substantially aligns with first aperture 223 and second aperture 224. Pin 295 may be positioned within first aperture 223, opening 291, and second aperture 224 so as to secure forward block 285 to manufactured sight 215. Alternatively, pin 295 passes through first aperture 223, and passes into forward block 285, but does not pass into second aperture 224. Pin 295 may comprise a fastener such as screw 296, for example a hex headed machine screw. Pin 295 may include head 297 that may engage first side wall 220.

Forward block 285 may be constrained within manufactured sight 215 such that movement of rail 150 is minimized. For example, first side surface 286 may contact first side wall 220 and second side surface 287 may contact second side wall 225 to as to minimize side-to-side movement of forward block 285 within receiving area 240. End surface 288 may contact end wall 227 so as to restrict back-and-forth movement of forward block 285. Floor surface 289 may contact base 230 so as to restrict up-and-down movement of forward block 285. In addition pin 295 positioned within forward block 285 and within first side wall 220 and second side wall 225 may restrict movement of forward block 285 and rail 150 with respect to firearm 110.

Pin 295 may include threads (not shown). Forward block 285 may include reciprocal threads (not shown) such that pin 295 threadedly engages forward block 285. In other embodiments, pin 295 does not include threads. First aperture 223 and second aperture 224 may or may not include threads. It is noted that in the as manufactured condition, first aperture 223 and second aperture 224 of the SKS firearm were typically not threaded.

Pin 295 may be positioned such that pin 295 does not interfere with pivoting or operation of latch 260 in second side wall 225. For example, pin 295 may not extend into second side wall 225. Alternatively, pin 295 may extend partially into second aperture 224 of second side wall 225 such that pin 295 does not extend beyond second side wall 225 so as to interfere with latch 260. In a further embodiment, opening 291 in forward block 285 comprises a blind hole so that pin 295 cannot extend out of forward block 285 to approach second side wall 225.

The illustration of firearm environment 100 and rear sight environment 200 is not meant to imply physical architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some illustrative embodiments, rail 150 may include additional points of connection with firearm 110. A portion of firearm 110 may be drilled and tapped so as to receive threaded fasteners that engage rail 150 to firearm 110. In still other illustrative embodiments, rail 150 may include a compression type connector to engage with firearm 110. These and other features may be present.

Figure 3:
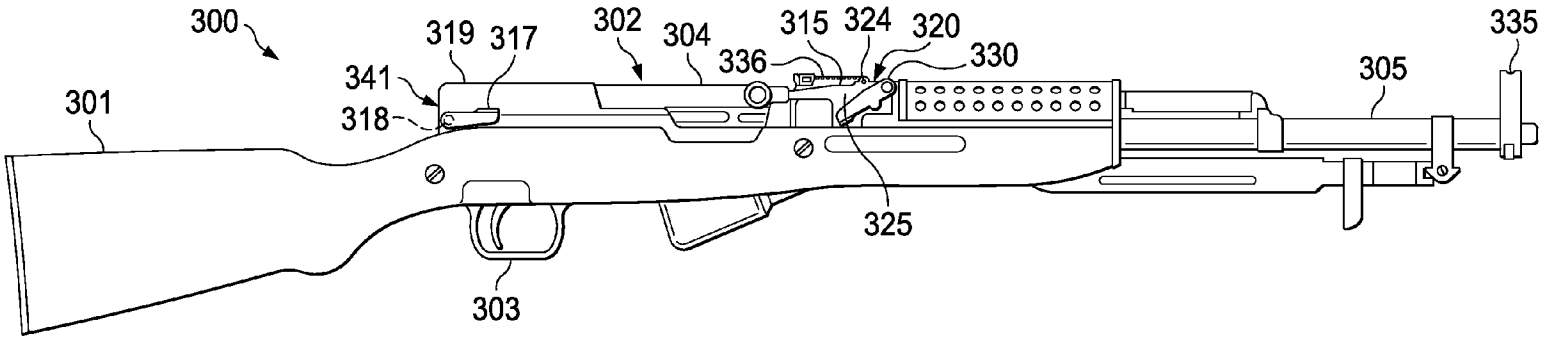
FIG. 3 is an illustration of a firearm for use with embodiments of the present invention in accordance with an illustrative embodiment.

With reference now to FIG. 3, an illustration of a firearm is depicted in accordance with an illustrative embodiment. Firearm 300 is an example of one physical implementation for firearm 110 shown in block form in FIG. 1. Firearm 300 may comprise stock 301, receiver 302, trigger 303, bolt 304, barrel 305, rear sight 330, and front sight 335. Firearm 300 depicted in FIG. 3 may be an SKS firearm. Firearm 300 may also include other features in addition to those illustrated in FIG. 1.

SKS assault rifles, such as depicted in FIG. 3, were typically produced with factory manufactured iron sights in the rear sight location and front sight location. The factory manufactured sights include rear sight 330 and front sight 335. Rear sight 330 included adjustable member 336. Aiming of the firearm was achieved by aligning various points of rear sight 330 and front sight 335. Adjustable member 336 is pivotably mounted to each of first side wall 320 and second side wall 325. First side wall 320 may include first aperture 323 (shown in FIG. 4), and second side wall 325 may include second aperture 324. First aperture 323 and second aperture 324 may receive prongs from adjustable member 336. Adjustable member 336 may be removed from rear sight 330 by an operator so as leave manufactured sight 315 in place on firearm 310. In manufactured sight 315, first aperture 323 and second aperture 324 may have a diameter that will receive a no. 6 hex head machine screw.

As manufactured, an SKS firearm includes receiver cover 319, which may be removed from firearm 300. Receiver cover 319 may be positioned to cover an opening in the receiver area through which bolt 304 passes during operation. A spring (not shown) may be positioned between bolt 304 and a rear position of receiver cover 319 so as to provide a biasing force against bolt 304. Receiver cover 319 may be held in place with through pin 318.

Receiver cover 319 may be removed by an operator. Rear latch 317 may be rotated so as to align a nib in through pin 318 with a groove in receiver cover 319. Through pin 318 may then be pulled through receiver cover 319 thereby freeing receiver cover 319 from its secure position. Receiver cover 319 may then be removed from firearm 300. Removal of receiver cover 319 exposes rear receiving area 341 in firearm 300. As explained further herein, rear receiving area 341 may provide an attachment point for an accessory rail.

Figure 4:
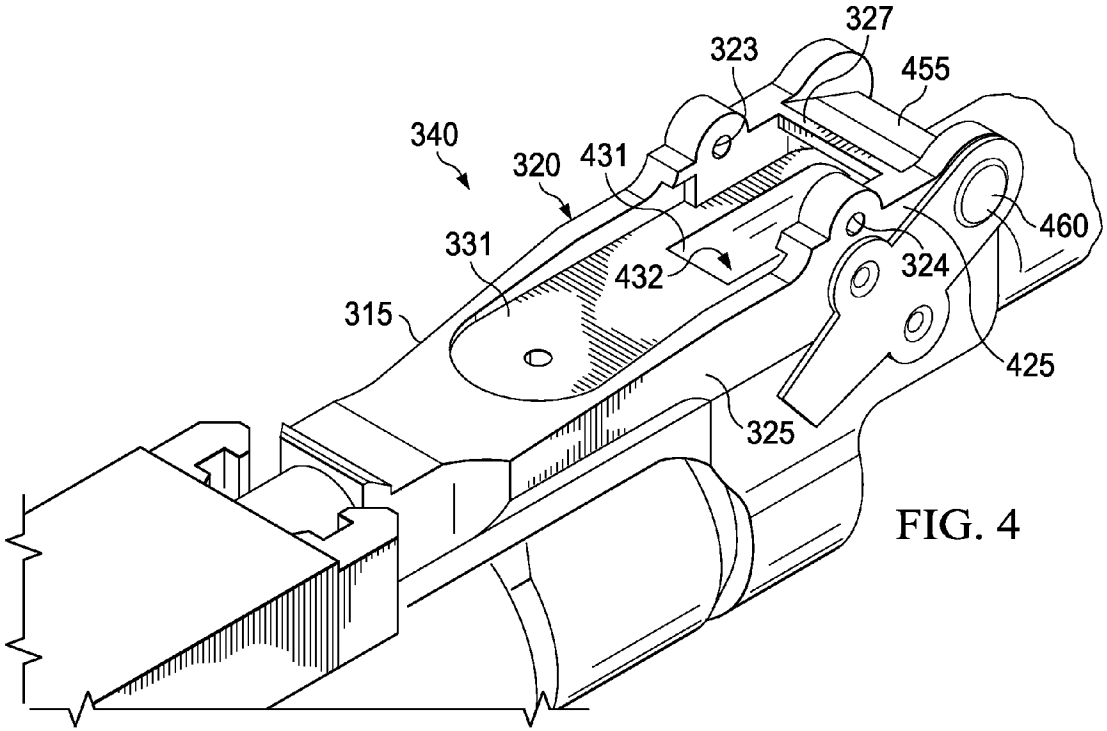
FIG. 4 is an illustration of a rear sight of a firearm for use with embodiments of the present invention in accordance with an illustrative embodiment.
Figure 5:
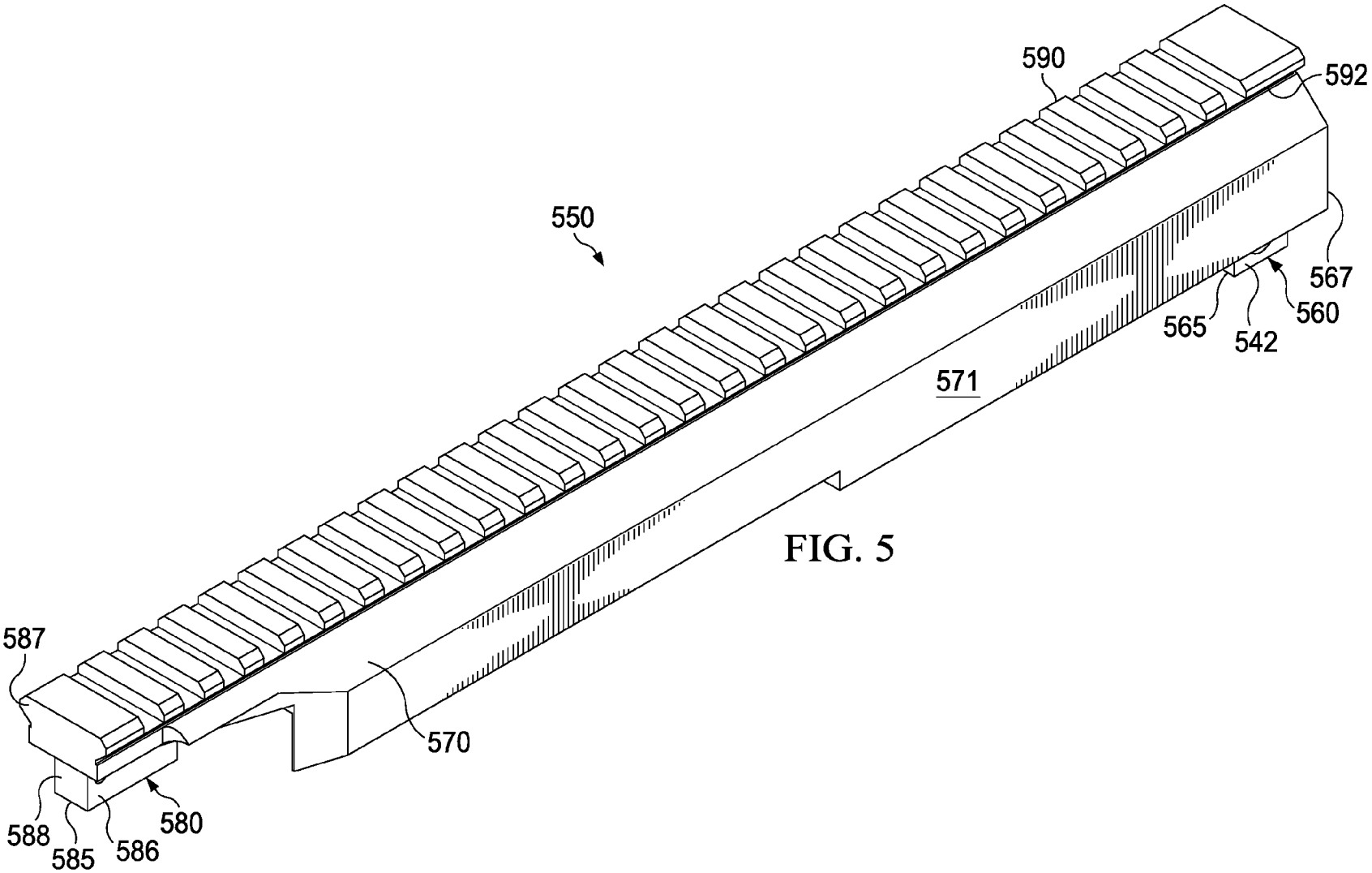
FIG. 5 is an illustration of an accessory rail in perspective view in accordance with an illustrative embodiment.

Referring now to FIG. 4, manufactured sight 315 is depicted in accordance with an illustrative embodiment. Manufactured sight 315 is an example of one implementation for manufactured sight 215 depicted in FIG. 2. Manufactured sight 315 may include first side wall 320, second side wall 325, end wall 327, and base 330. First aperture 323 may be present in first side wall 320, and second aperture 324 may be present in second side wall 325. First side wall 320, second side wall 325, end wall 327, and base 330 may define receiving area 340. It is noted that adjustable member 336 has been removed from manufactured sight 315 in FIG. 4 so as to illustrate the area provided in receiving area 340. Receiving area 340 may provide an attachment point for an accessory rail as described herein.

Manufactured sight 315 may also comprise channel 431. Gas tube 432 may be positioned within channel 431. Screen 455 may be pivotably connected to manufactured sight 315, and screen 455 may transition between an open position and a closed position. Gas tube 432 may be concealed within channel 431 in the closed position. A user may access gas tube 432, for example to clean gas tube 432, through screen 455 when screen 455 is in the open position. Latch 460 may be positioned on second side wall 425 of manufactured sight 315. Movement of latch 460 may move screen 455 from the closed position to the open position and vice versa. Latch 460 may move such that it crosses over second aperture 324 in second side wall 425 when latch 460 moves from a first position to a second position.

First side wall 320 may include first aperture 323, and second side wall 325 may include second aperture 324. Adjustable member 336 (shown in FIG. 3) has been removed from first aperture 323 and second aperture 324 in FIG. 4. First side wall 320, second side wall 425, end wall 327, and base 330 may define receiving area 340 having a generally rectilinear configuration.

With reference now to FIG. 5-8, an illustration of accessory rail 550 is depicted in accordance with an illustrative embodiment. As above, unless otherwise noted and where appropriate, similarly named features and elements of an embodiment of one figure of the disclosure correspond to and embody similarly named features and elements of embodiments of the other figures of the disclosure. Accessory rail 550 is an example of one implementation for rail 150 in FIG. 1. Accessory rail 550 is depicted in a generally top perspective view in FIG. 5, in a first side view in FIG. 6, in a second side view in FIG. 7, and in a lower perspective view in FIG. 8. These Figures are discussed together because some features may be obscured depending on the view presented in an individual Figure.

Accessory rail 550 may comprise number of ridges 590 extending from body 570. Accessory rail 550 may further comprise first attachment structure 560 and second attachment structure 580. First attachment structure 560 may comprise rear block 565, and second attachment structure 580 may comprise forward block 585. Accessory rail 550 may further include first wall 571 and second wall 573.

Number of ridges 590 may comprise a plurality of ridges that extend from top surface 592 of body 570. An alternating series of protrusions and valleys may define number of ridges 590 and may be configured to receive an accessory, such as an optical scope. Number of ridges 590 may extend substantially along a length of accessory rail 550; alternatively number of ridges 590 may be shorter than accessory rail 550. Number of ridges 590 may substantially conform to a defined specification such as MIL-STD-1913 for what is known as a Picatinny rail. Alternatively, number of ridges 590 may have another configuration.

Top surface 592, first wall 573 and second wall 575 of body 570 may define cavity 577. Cavity 577 may be configured so as to receive a portion of firearm 110. Cavity 577 may also be configured with sufficient room so as to allow bolt 304 to traverse through cavity 577 during cycling of bolt 304 that occurs during operation.

Body 570 may be positioned with respect to firearm 110 so as to have an engaged position and a disengaged position. At least one of top surface 592, first wall 573, and second wall 575 may be in contact with firearm 110 in the engaged position. In one embodiment, each of top surface 592, first wall 573, and second wall 575 contact firearm 110 in the engaged position. Contact between body 570 and firearm 110 may serve to substantially engage accessory rail 550 to firearm 110 so as to provide a secure and steady platform upon which to affix accessory 125 related to performance of firearm 110.

First attachment structure 560 may include rear block 565. Rear block 565 may be positioned at or proximate to a rear end 567 of accessory rail 550. Rear block 565 may be configured to engage rear receiving area 341 of firearm 300. Rear block 565 may include first surface 542, second surface 543, and base 544. Rear opening 545 may pass through rear block 565. Rear opening 545 may be configured to receive rear through pin of firearm (not shown). Rear block 565 may be generally rectangular/rectilinear in one embodiment, and may take other configurations in other embodiments.

Second attachment structure 580 may include forward block 585. Forward block 585 may be positioned at or proximate forward end 587 of accessory rail 550. Forward block 585 may be configured to engage receiving area 240 of firearm 110. Forward block 585 may include first side surface 586, second side surface 597, end surface 588, and floor surface 589. Forward opening 591 may be present in forward block 585. Forward opening 591 may comprise a complete opening that passes from first side surface 586 to second side surface 597. Alternatively, opening 591 may comprise a blind hole that passes only through one surface, such as first side surface 586. Forward block 585 may be generally rectangular/rectilinear in one embodiment, and may take other configurations in other embodiments.

In one embodiment, first attachment structure 560 and second attachment structure 580 may be positioned on a lower portion of accessory rail 550. Number of ridges 590 may be positioned on an upper portion of accessory rail 550. This positioning may allow number of ridges 590 to function with respect to accessory 125 without interference from first attachment structure 560 and second attachment structure 580.

First wall 571 may include first receiver rail 581 in a generally rear portion of first wall 520, and second wall 573 may include second receiver rail 582 in a generally rear portion of second wall 573. When accessory rail 550 is in the engaged position with respect to firearm 110, first receiver rail 581 may contact a first portion of receiver 302, and second receiver rail 582 may contact a second portion of receiver 302.

Second wall 525 may also include space 502 and deflector 503. Space 502 may comprise a break or opening in second wall 575; space 502 provides room for a spent shell to be ejected from the receiver of firearm 110. Deflector 503 may comprise a lip or extension of material from body 570. Deflector 503 is configured to be positioned proximate receiver 302 of firearm 110 in the area where shells are expelled through receiver 302. Deflector 503 is configured such that spent shells may contact deflector 503 upon ejection. Deflector 503 may then direct the shells in a desired direction. In one illustrative embodiment, deflector 503 prevents ejected shells from contacting an accessory positioned above receiver. An accessory such as a scope would typically be positioned in a general position above receiver 302, and deflector 503 may prevent shells from hitting the scope. Deflector 503 may also be configured to eject shells in a forward direction, relative to the operator, so as to avoid interference or contact with the operator. Deflector 503 may also be configured to eject shells in other directions.

In one embodiment top surface 592 and number of ridges 590 are substantially planar. A planar configuration may provide an even platform upon which to attach accessories. In addition first wall 571 and second wall 573 are substantially planar. However, other configurations are possible. In addition, rear block 565 may be set in a lower position relative to forward block 585.

Accessory rail 550 may be formed of metallic materials or other sufficiently rigid materials. For example, accessory rail 550 may be formed of aluminum or aluminum alloys. In one embodiment, accessory rail 550 may be machined from bar stock material. Other suitable manufacturing methods may be followed. Rigidity of materials may advantageous. Accessory rail 550 may be substantially rigid.

Accessory rail 550 and its related features have been described with respect to FIGS. 5-8 in general terms without dimensional limitations and should be so understood. However, by way of example only, according to one illustrative embodiment, accessory rail may take on the following dimensions. Accessory rail 550 may have a length from rear end 567 to forward end 587 of up to about 300 mm and a width of up to about 24 mm. Rear block 565 may have a length of up to about 20 mm, and forward block 585 may have a length of up to about 15 mm. Space 502 may include a length of up to about 120 mm.

Figure 6:
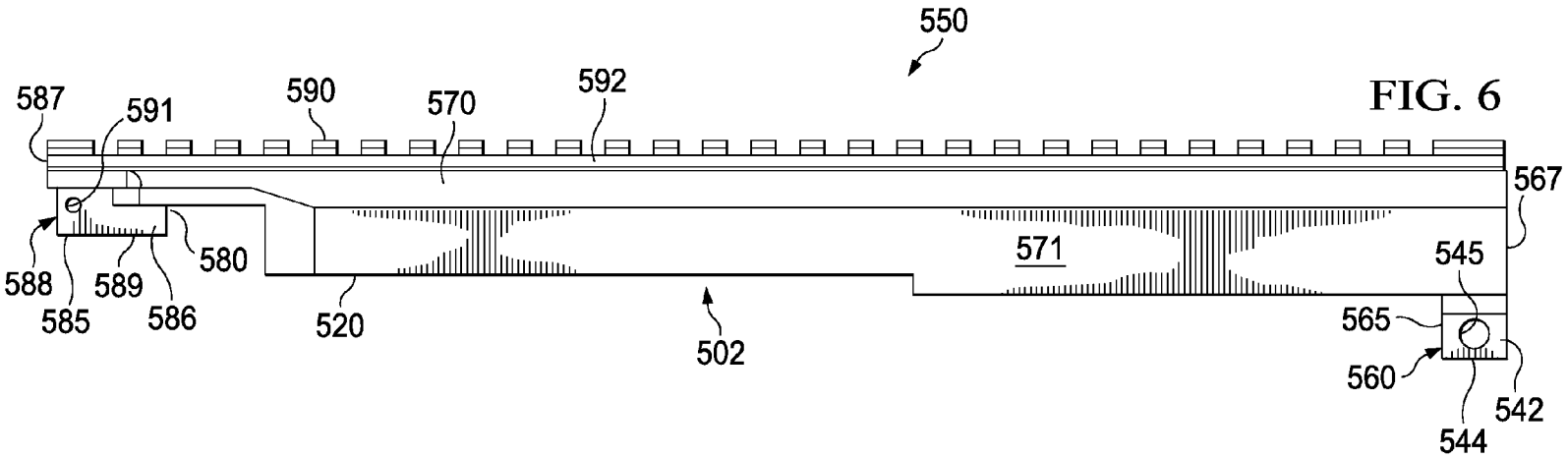
FIG. 6 is an illustration of an accessory rail in a first side view in accordance with an illustrative embodiment.

With reference now to FIG. 6, a further illustration of accessory rail 550 is depicted in accordance with an illustrative embodiment. Accessory rail 550 is an example of one implementation for rail 150 in FIG. 1. FIG. 6 generally illustrates a first side view of accessory rail 550. Accessory rail 550 may include first wall 571. Number of ridges 590 may extend from top surface 592 of body 570. First attachment structure 560 with rear block 565 may be positioned proximate rear end 567 of accessory rail 550, and second attachment structure 580 with forward block 585 may be positioned proximate forward end 587 of accessory rail 550.

Figure 7:
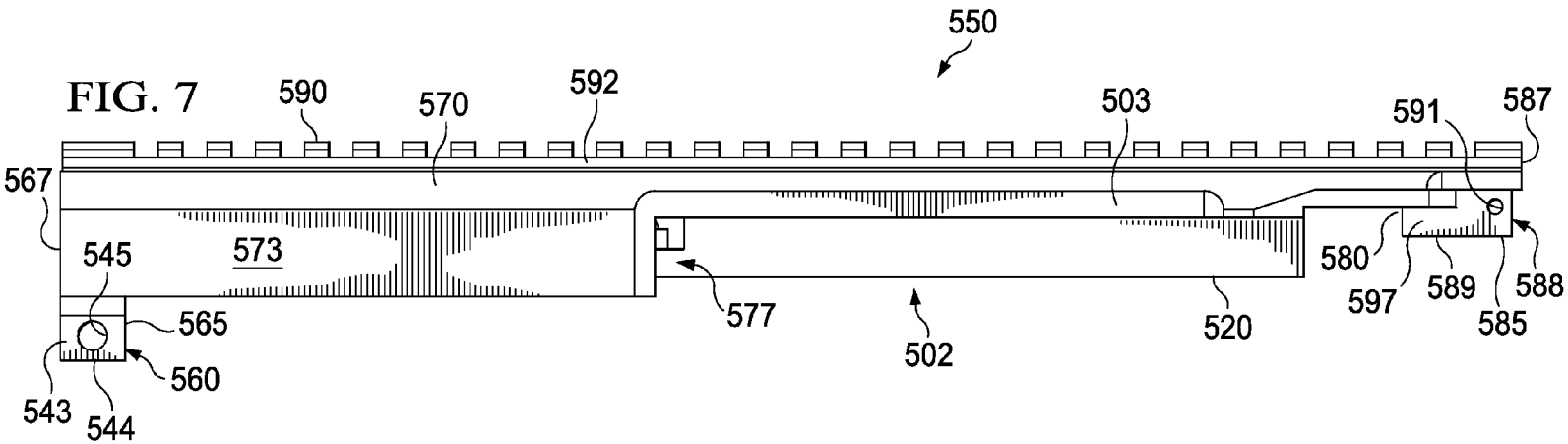
FIG. 7 is an illustration of an accessory rail in a second side view in accordance with an illustrative embodiment.

With reference now to FIG. 7, a further illustration of accessory rail 550 is depicted in accordance with an illustrative embodiment. Accessory rail 550 is an example of one implementation for rail 150 in FIG. 1. FIG. 7 generally illustrates a second side view of accessory rail 550. Accessory rail 550 may include second wall 573. Space 502 may be included in accessory rail 550. Deflector 503 may be positioned proximate space 502 on accessory rail 550.

Figure 8:
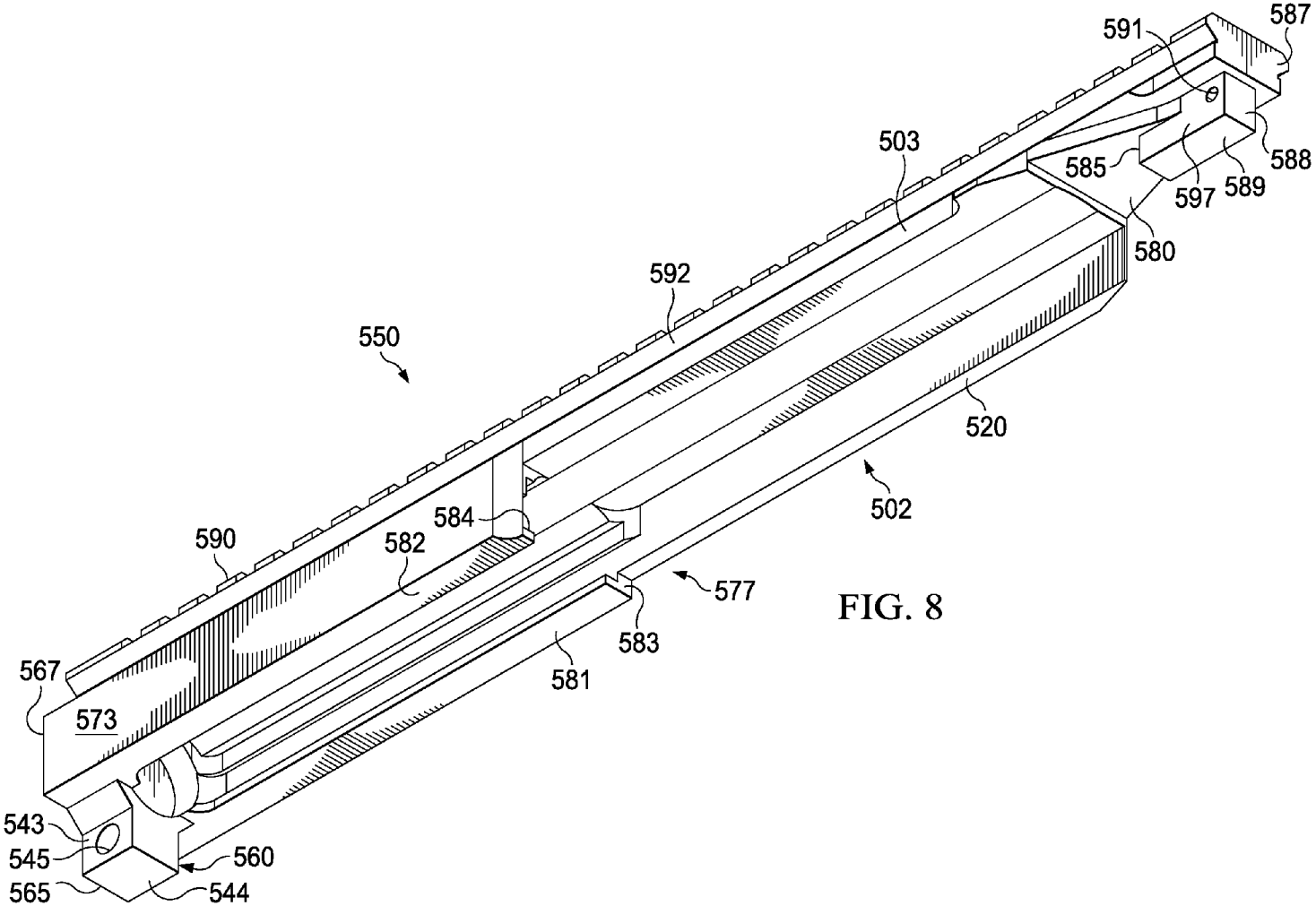
FIG. 8 is an illustration of an accessory rail in perspective view in accordance with an illustrative embodiment.

With reference now to FIG. 8, a further illustration of accessory rail 200 is depicted in accordance with an illustrative embodiment. Accessory rail 550 is an example of one implementation for rail 150 in FIG. 1. FIG. 8 illustrates accessory rail 550 from a generally bottom perspective view. Accessory rail 550 may include body 570 that includes first wall 571, second wall 573, and top surface 592. An inner portion of top surface 592 is shown in FIG. 8. Cavity 577 may be defined in accessory rail 550 by first wall 573, second wall 573, and top surface 592. Cavity 577 may be generally formed so as to accommodate and attach to firearm 300. Deflector 503 may be positioned proximate space 502 on accessory rail 550.

First wall 571 may include first receiver rail 581, and second wall 573 may include second receiver rail 582. First receiver rail 581 may include first receiver stop 583, and second receiver rail 582 may include second receiver stop 584. When accessory rail 550 is engaged with firearm 300, first receiver rail 581 may rest on a first portion of receiver 302 and second receiver rail 582 may rest on a second portion of receiver 302. In addition first receiver stop 583 may contact a first edge portion of receiver 302, and second receiver stop 584 may contact a second edge portion of receiver 302.

Figure 9:
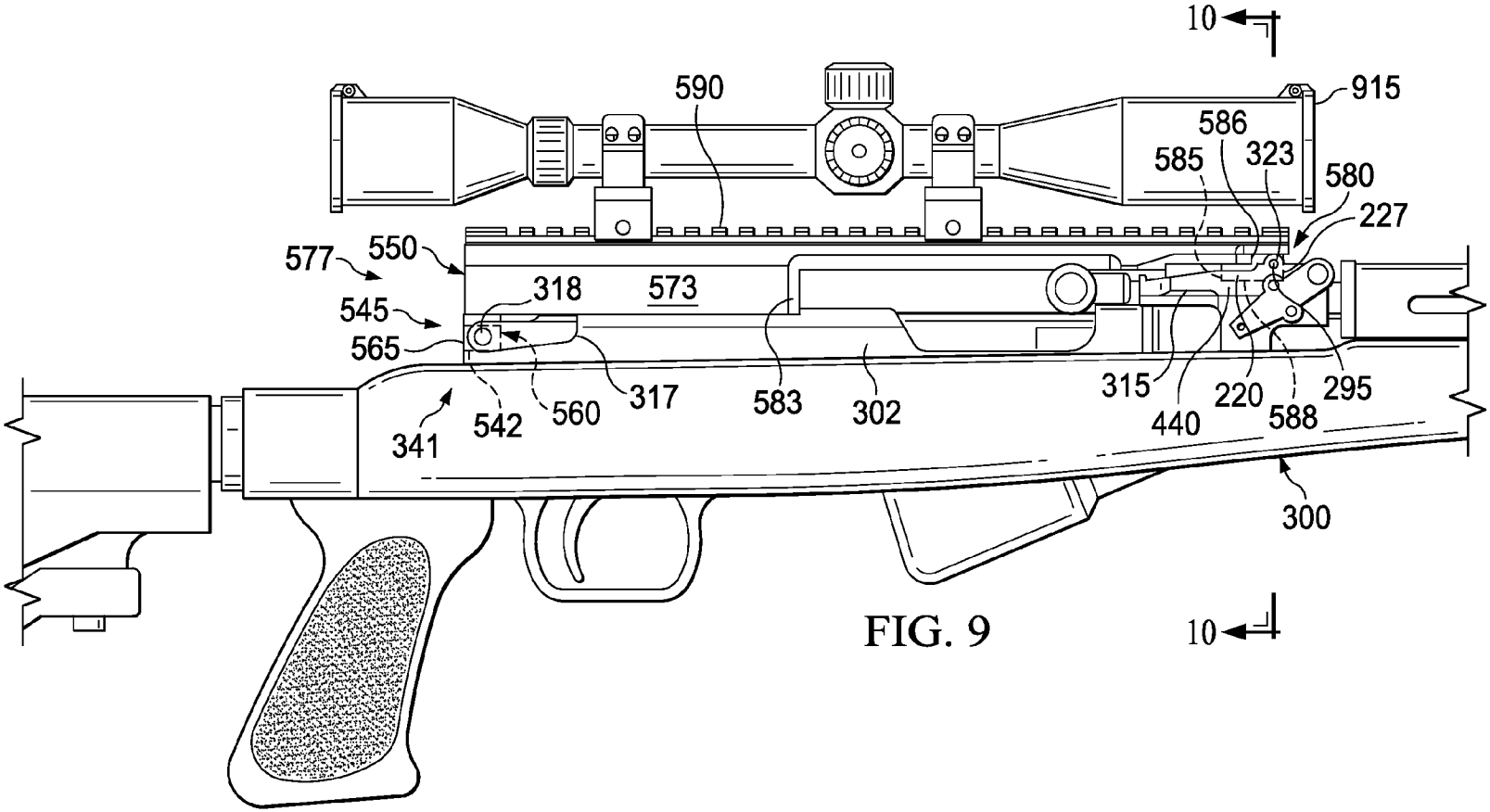
FIG. 9 is an illustration of an accessory rail attached to a firearm in accordance with an illustrative embodiment.

With reference now to FIG. 9, an illustration of an accessory rail attached to a firearm is depicted according to an illustrative embodiment. Accessory rail 550 and firearm 300 are both examples of one implementation for rail 150 and firearm 110 in FIG. 1. Accessory rail 550 may be engaged with firearm 300. It is noted that receiver cover 319 (not shown) has been removed from firearm 300. Adjustable member 316 has also been removed from rear sight 330. Accessory rail 550 may be positioned so that cavity 577 contacts a portion of firearm 300. First attachment structure 560 may be positioned so that rear block 565 engages rear receiving area 341. Second attachment structure 580 may be positioned so that forward block 585 engages receiving area 440.

First receiver rail 581 of first wall 573 may rest on a first receiver portion, and second receiver rail 582 (not shown) of second wall 573 (not shown) may rest on a second receiver portion. Accessory 915 may be attached to number of ridges 590. First receiver stop 583 may contact a first end of receiver 302, and second receiver stop 584 (not shown) may contact a second end of receiver 302.

Rear block 565 may be positioned to engage rear receiving area 341. First surface 542 and second surface 543 (not shown) of rear block 565 may be positioned between a first interior facade and a second interior facade of receiver 302. Rear opening 545 in rear block 565 may be positioned so as to receive through pin 318. A groove (not shown) may be provided in rear block 565 to accommodate a nib present in through pin 318. Through pin 318 may extend through rear block 565 such that through pin 318 engages with an opposite receiver structure. Rear latch 317 may be rotated from a first position to a second position so as to secure through pin 318 to receiver 302.

Through pin 318 is part of the SKS firearm as manufactured. Rear block 565 as described may be used with through pin 318. Use of through pin 318 may provide an advantage in that there may be no need to machine or modify firearm 300. Thus, once a user decides to remove accessory rail 550 from firearm 300, firearm 300 can be returned to its original configuration. Optionally, through pin 318 may be removed, and a screw may be used to affix rear block 565 to receiver 302. Threads may be formed in rear opening 545 in order to receive screw. Threads would not have to be formed in receiver 302 so long as the shank portion of screw could pass through the access hole provided for through pin 318. It is believed that use of a screw in place of through pin 318 may provide an advantage in that a screw threadedly engaged with rear block 565 may provide a firmer attachment of rear block 565 to rear receiving area 341. Conversely, removal of through pin 318 may provide a disadvantage in that firearm 300 is modified from its original condition.

Forward block 585 may be positioned to engage receiving area 440 of manufactured sight 315. Further, forward block 585 may be positioned with respect to manufactured sight 315 so that one or more surfaces of forward block 585 contact one or more portions of manufactured sight 315. For example, first side surface 586 may contact first side wall 220; second side surface 597 may contact second side wall 225 (not shown); end surface 588 may contact end wall 227; and floor surface 589 (not shown) may contact base 230 (not shown). Forward block 585 may also be positioned with respect to receiving area 440 such that opening 591 in forward block 585 substantially aligns with first aperture 323 and second aperture 324. Alternatively, opening 591 may substantially align with at least one of first aperture 323 and second aperture 324, such as aligning with first aperture 323. Pin 295 may be positioned within first aperture 323, opening 591, and second aperture 324 so as to secure forward block 585 to manufactured sight 315. Alternatively, pin 295 may secure forward block 585 to one of first side wall 220 or second side wall 225. Pin 295 may comprise a fastener such as machine screw 296.

The positioning and securing of forward block 585 may constrain or reduce the movement of forward block 585 within manufactured sight 315. The constraint of forward block 585 may also restrict movement of accessory rail 550 with respect to firearm 300. For example, first side surface 586 may contact first side wall 220 and second side surface 597 may contact second side wall 225, thereby reducing possible side to side movement of forward block 585 within receiving area 340. End surface 588 may contact end wall 227 so as to restrict back and forth movement, and floor surface 589 may contact base 230 so as to restrict up and down movement. In addition pin 295 positioned within forward block 585 and within first side wall 220 and second side wall 225 may restrict movement of forward block 585.

Accessory 915 may be attached to number of ridges 590 of accessory rail 550. For example an optical scope may include brackets or other attachment means configured to engage number of ridges 590. Accessories may be manufactured or otherwise provided with attachment means configured to engage number of ridges 590 such as in a Picatinny rail.

In operation, accessory rail 550 provides a substantially rigid and fixed platform with respect to firearm 300. The performance of accessory 915, when attached to accessory rail 550, benefits from the firm attachment of accessory rail 550. For example an accessory such as an optical scope relies on a fixed relationship between the optical structures within the scope and the firearm to which it is attached. Movement of the scope with respect to the firearm, even very small movements, decreases the accuracy and performance of the scope/firearm combination. Accessory rail 550 overcomes such deficiencies and improves performance by minimizing possible movement of accessory rail 550 with respect to firearm 300.

Accessory rail 550 may provide two attachment points by which accessory rail 550 may be connected to firearm 300. First attachment structure 560 may attach accessory rail 550 to firearm 300 at a first attachment point, and second attachment structure 580 may attach accessory rail 550 at a second attachment point. Two attachment points provide a stable connection between accessory rail 550 and firearm 300. In addition, first attachment structure 560 may be separated from second attachment structure 580 along the length of accessory rail 550. The separation of first attachment structure 560 from second attachment structure 580 may also provide an enhanced stability for accessory rail 550.

Figure 10:
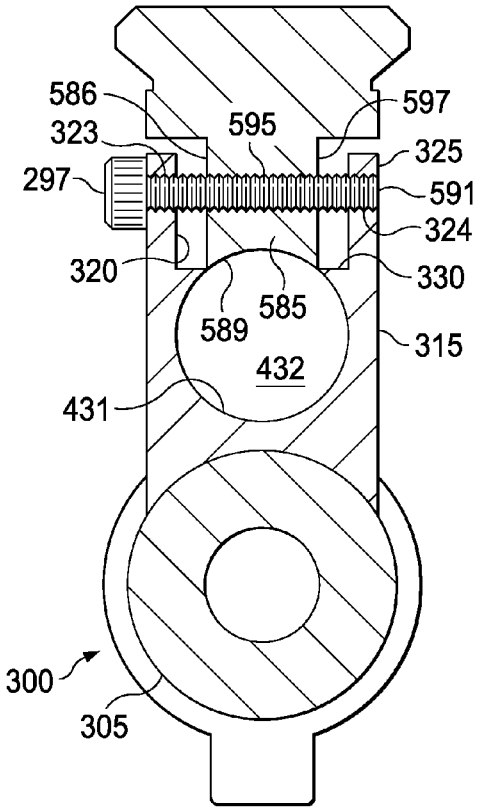
FIG. 10 is an illustration of a cut away view of an accessory rail engaged with a rear sight of a firearm in accordance with an illustrative embodiment.

With reference now to FIG. 10, an illustration of an accessory rail engaged with a rear sight of a firearm is depicted in accordance with an illustrative embodiment. Forward block 585 is an example of one implementation of forward block 285 in FIG. 2. Forward block 585 is shown in cut away view along line 10-10 from FIG. 9. Firearm 300 includes barrel 305 and manufactured sight 315. Gas tube 432 may be positioned within channel 431 defined between barrel 305 and manufactured sight 315.

Forward block 585 may be positioned in receiving area 341 of manufactured sight 315. Forward block 585 may be positioned between first side wall 320 and second side wall 325. Forward block 585 may have dimensions such that first side surface 586 contacts first side wall 320 and second side surface 597 contacts second side wall 325. In addition floor surface 589 may contact base 330.

Pin 595 may be positioned so as to engage first side wall 320 and forward block 585. Pin 595 may be positioned so as to extend through first aperture 323 in first side wall 320. Head 297 of pin 595 may remain on one side of side wall 320. Pin 595 extends through first aperture 323 and into opening 591 of forward block 585. In the embodiment depicted in FIG. 10, pin 595 may not extend into second wall 325. Second aperture 324 in second side wall 325 may remain empty.

Figure 11:
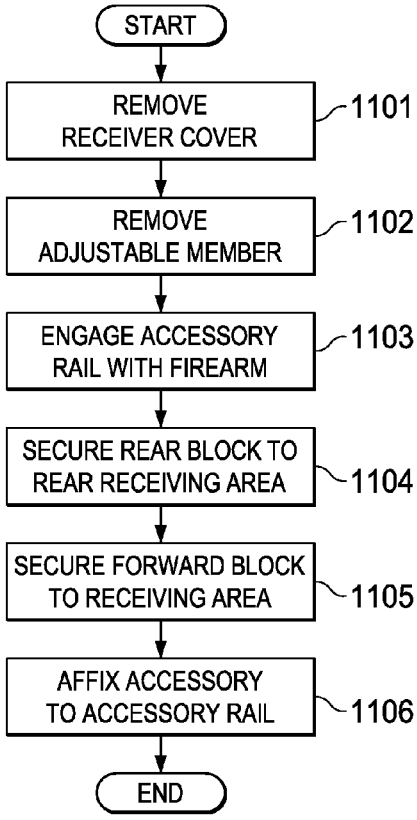
FIG. 11 is an illustration of a flow chart of a process for attaching an accessory rail to a firearm in accordance with an illustrative embodiment.

With reference now to FIG. 11, an illustration of a flowchart of a process for attaching an accessory rail to an SKS firearm is depicted in accordance with an illustrative embodiment. The process illustrated in FIG. 11 may be implemented using rail 150 with firearm 110 as depicted in firearm environment 100 in FIG. 1.

The process may begin by removing manufactured equipment from firearm 110. Receiver cover 119 may be removed from firearm 110 (operation 1101). Removal of receiver cover 119 may be obtained by rotating rear latch 317 so as to rotate through pin 318. Through Pin 318 may be rotated until a nib aligns with groove in receiver cover 119. Through pin 318 may then be drawn through receiver cover 119 so as to free receiver cover 119 from an attached configuration. Removal of receiver cover 119 exposes rear receiving area 341 in firearm 110.

In a further step, adjustable member 336 may be removed from rear sight 130 (operation 1102). Manufactured sight 215 remains after removal of adjustable member 336. Receiving area 240 is exposed in manufactured sight 215.

In a further step, accessory rail 550 may be engaged with firearm 300 (operation 1103). Accessory rail 550 may be brought into proximity with firearm 300 such that cavity 577 contacts firearm 300. First attachment structure 560 may be positioned so that rear block 565 engages rear receiving area 341. Second attachment structure 580 may be positioned so that forward block 585 engages receiving area 440. First receiver rail 581 of first wall 573 may rest on a left receiver portion, and second receiver rail 582 of second wall 575 may rest on a right receiver portion.

In a further step, rear block 565 may be secured to rear receiving area 341 (operation 1104). Rear opening 545 in rear block 565 may receive through pin 318. A groove may be provided in rear block 565 to accommodate a nib present in through pin 318. Through pin 318 may then be extended through rear block 565 until through pin 318 engages with an opposite receiver structure. Rear latch 317 may be rotated so as to secure through pin 318 to receiver 302.

In a further step, forward block 585 may be secured to receiving area 340 (operation 1105). Forward block 585 may be positioned in receiving area 341 of manufactured sight 315. Forward block 585 may be positioned between first side wall 320 and second side wall 325. First side surface 586 may contact first side wall 320, and second side surface 587 may contact second side wall 325. In addition floor surface 589 may contact base 330. Pin 595 may be positioned so as to engage first side wall 320, forward block 585, and optionally second side wall 325. Head 297 of pin 595 may remain on one side of side wall 320.

In a further step, accessory 125 may be affixed to number of ridges 590 on accessory rail 550 (operation 1106). Accessory 125 may be affixed, for example, as an accessory is affixed to a Picatinny type rail.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

For example, without limitation, in some illustrative examples, operation 1104 in FIG. 11 may be omitted. In other illustrative examples, operation 1104 and operation 1105 in FIG. 11 may be performed in reverse order. In other words, a rear block attachment may be optional in some embodiments of the invention. Further, the steps in FIG. 11 may be substantially reversed so as to remove an accessory from a number of ridges, remove the accessory rail from the firearm, and replace the receiver cover and the adjustable member. Thus, the operation in FIG. 11 may be reversed so as to return the firearm to its as-manufactured condition.

Thus, the different illustrative embodiments provide an accessory rail and method for attaching the accessory rail to a firearm. An accessory rail may include a rear block and forward block positioned respectively at a rear end and forward end of the accessory rail. The rear block may be configured to engage a first receiving area of the firearm, and the forward block may be configured to engage a second receiving area of the firearm. The accessory rail can advantageously be connected to a firearm such as the Samozaryadnj Karabin sistemy Simonova (SKS) assault rifle by utilizing manufactured points present in the SKS. For example, the rear block may engage an attachment point provided for the receiver cover of the firearm. The forward block may engage a receiving area that is provided in the rear sight of the firearm. No machining modifications to the firearm are required in order to attach the accessory rail described herein. Further, the accessory rail provides two points of attachment, which are spaced apart from each other, thus improving the stability and performance of the accessory rail as a platform for other accessories such as optical scopes.

While the illustrative embodiments have been described for with an SKS assault rifle, it should be appreciated that the illustrative embodiments may also be used with other kinds of firearms. For example, an accessory rail may be connected to any firearm that includes a front sight that can receive the forward block of the accessory rail.

The description of the different advantageous embodiments has been presented for purposes of illustration and description and is not intended to be exhaustive or limited to the embodiments in the form disclosed. Many modifications and variations may be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An accessory rail, for a firearm, comprising:

a first receiver rail configured to engage a first side of a receiver of the firearm;

a second receiver rail configured to engage a second side of the receiver of the firearm:

a bar comprising a first end and a second end, the bar configured to engage the firearm, wherein the firearm comprises a rear sight structure that comprises: a space defined between a first surface and a second surface, and an opening aligned between the first surface and the second surface;

a first attachment structure, proximate the first end of the bar, configured to attach the bar to the firearm; and a second attachment structure proximate the second end of the bar, the second attachment structure comprising a block that comprises a first side face and a second side face configured to rest in the space in the rear sight of the firearm with the first side face and the second side face adjacent to the first surface and the second surface of the rear sight of the firearm respectively, such that an aperture in the block aligns with the opening in the rear sight of the firearm, and a machine screw positioned in the aperture and the opening so as to attach the second attachment structure to the bar.

2. The accessory rail of claim 1 wherein the block comprises a front face, the front face contacting the rear sight.

3. The accessory rail of claim 1, wherein the block comprises a bottom face contacting a surface of the rear sight.

4. The accessory rail of claim 1, wherein the block comprises a groove configured to receive a tube of the firearm disposed in the groove.

5. The accessory rail of claim 1, wherein the first attachment structure comprises a first aperture and a fastener positioned within the aperture.

6. An assembly, comprising:

a rear sight of a firearm, wherein the firearm comprises a Samozaryadnj Karabin sistemy Simonova (SKS) firearm, the rear sight structure including a space defined between a first surface and a second surface and an opening aligned between the first surface and the second surface;

a rail having a first end and a second end, the rail engaging the firearm;

a first connector structure proximate the first end of the rail;

a second connector structure proximate the second end of the rail, the first connector structure attaching the rail to the firearm at a first point, the second connector structure comprising a block, the block entering the space in the rear sight of the firearm and attaching the rail to the firearm at a second point, wherein the block comprises a first side face and a second side face, the first side face and the second side face adjacent to the rear sight, the second connector structure comprising an aperture aligned with the opening; and a machine screw positioned within the aperture and the opening.

7. The assembly of claim 6 wherein the block comprises a front face, the front face contacting the rear sight.

8. The assembly of claim 6, wherein the block comprises a bottom face contacting a surface of the rear sight.

9. The assembly of claim 6, wherein the firearm comprises a tube and the block comprises a groove, the tube disposed in the groove.

10. The assembly of claim 6, wherein the firearm comprises a receiver and the rail comprises carrier rails engaging a first side of the receiver and a second side of the receiver.

11. The assembly of claim 6, wherein the first connector comprises a first aperture and a fastener positioned within the aperture.

* * * * *